US009869946B1

(12) United States Patent
Kasuya

(10) Patent No.: US 9,869,946 B1
(45) Date of Patent: Jan. 16, 2018

(54) EXPOSURE DEVICE AND IMAGE FORMING APPARATUS

(71) Applicant: FUJI XEROX CO., LTD., Tokyo (JP)

(72) Inventor: Yosuke Kasuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/341,091

(22) Filed: Nov. 2, 2016

(30) Foreign Application Priority Data

Jun. 30, 2016 (JP) ..... 2016-130672

(51) Int. Cl.
*G03G 15/04* (2006.01)

(52) U.S. Cl.
CPC ..... *G03G 15/04036* (2013.01)

(58) Field of Classification Search
CPC ..... G03G 15/04036
See application file for complete search history.

(56) References Cited

U.S. PATENT DOCUMENTS

| | | | | |
|---|---|---|---|---|
| 2004/0101327 | A1* | 5/2004 | Nomura | B41J 2/45 399/111 |
| 2005/0001896 | A1 | 1/2005 | Wakisaka | |
| 2008/0232856 | A1* | 9/2008 | Matsushita | G03G 15/326 399/220 |
| 2012/0075403 | A1 | 3/2012 | Nagamine et al. | |
| 2012/0114374 | A1* | 5/2012 | Suzuki | G03G 21/1821 399/111 |
| 2016/0085208 | A1 | 3/2016 | Imai | |

FOREIGN PATENT DOCUMENTS

| | | |
|---|---|---|
| JP | H02-231163 | 9/1990 |
| JP | H05-301373 | 11/1993 |
| JP | H06-166211 | 6/1994 |
| JP | H06-166212 | 6/1994 |
| JP | H06-191090 | 7/1994 |
| JP | H06-198957 | 7/1994 |
| JP | 2002-326384 | 11/2002 |
| JP | 2003-098314 | 4/2003 |
| JP | 2003-103828 | 4/2003 |

(Continued)

OTHER PUBLICATIONS

Office Action and English Translation dated Dec. 13, 2016 in corresponding Japanese Patent Application No. 2016-130672.

(Continued)

*Primary Examiner* — G. M. Hyder
(74) *Attorney, Agent, or Firm* — Fildes & Outland, P.C.

(57) ABSTRACT

An exposure device includes: a substrate that includes a plate-shaped main body that extends in one direction, a plurality of light emitting elements that are mounted on one surface of the main body, and a heating element that is mounted on the other surface of the main body and generates heat in accordance with light emission of the light emitting element; a housing that extends in the one direction, has a frame shape in which a through hole is formed, and to an inside of the through hole of which the substrate is fixed so that a thickness direction of the main body is a penetrating direction of the through hole; and a first contact member that extends in the one direction, and is in contact with at least a portion of the heating element and the main body at a different position in the one direction.

4 Claims, 19 Drawing Sheets

(56) References Cited

FOREIGN PATENT DOCUMENTS

| | | |
|---|---|---|
| JP | 2007-234455 | 9/2007 |
| JP | 2009-218602 | 9/2009 |
| JP | 2009-274447 | 11/2009 |
| JP | 2010-064426 | 3/2010 |
| JP | 2010-177306 | 8/2010 |
| JP | 2012-024952 | 2/2012 |
| JP | 2012-066499 | 4/2012 |
| JP | 2013-220612 | 10/2013 |
| JP | 2014-162065 | 9/2014 |
| JP | 2016-060154 | 4/2016 |

OTHER PUBLICATIONS

English language machine translation of JP 2010-177306.
English language machine translation of JP 2009-218602.
English language machine translation of JP H06-198957.
English language machine translation of JP 2002-326384.
English language machine translation of JP H05-301373.
English language machine translation of JP H02-231163.
English language machine translation of JP H06-166211.
English language machine translation of JP 2012-024952.
English language machine translation of JP 2009-274447.
English language machine translation of JP H06-191090.
English language machine translation of JP H06-166212.
English language machine translation of JP 2007-234455.
English language machine translation of JP 2003-098314.
English language machine translation of JP 2013-220612.
English language machine translation of JP 2010-064426.
English language machine translation of JP 2003-103828.
Abstract and machine translation of JP 2014-162065.

* cited by examiner

EXPOSURE DEVICE AND IMAGE FORMING APPARATUS

CROSS-REFERENCE TO RELATED APPLICATIONS

This application is based on and claims priority under 35 USC 119 from Japanese Patent Application No. 2016-130672, filed on Jun. 30, 2016.

TECHNICAL FIELD

The present invention relates to an exposure device and an image forming apparatus.

SUMMARY

An aspect of the present invention provides an exposure device including:

a substrate that includes a plate-shaped main body that extends in one direction, a plurality of light emitting elements that are mounted on one surface of the main body, and a heating element that is mounted on the other surface of the main body and generates heat in accordance with light emission of the light emitting element;

a housing that extends in the one direction, has a frame shape in which a through hole is formed, and to an inside of the through hole of which the substrate is fixed so that a thickness direction of the main body is a penetrating direction of the through hole; and a first contact member that extends in the one direction, and is in contact with at least a portion of the heating element and the main body at a different position in the one direction.

BRIEF DESCRIPTION OF THE DRAWINGS

Exemplary embodiments of the present invention will be described in detail based on the following figures, wherein.

DETAILED DESCRIPTION

First Exemplary Embodiment

An example of an exposure device and an image forming apparatus according to an first exemplary embodiment of the invention will be described with reference to FIGS. 1 to 14. An arrow H illustrated in the figure indicates an apparatus up-and-down direction (vertical direction), an arrow W indicates an apparatus width direction (horizontal direction), and an arrow D indicates the apparatus depth direction (horizontal direction).

(Overall Configuration)

Figure 14:
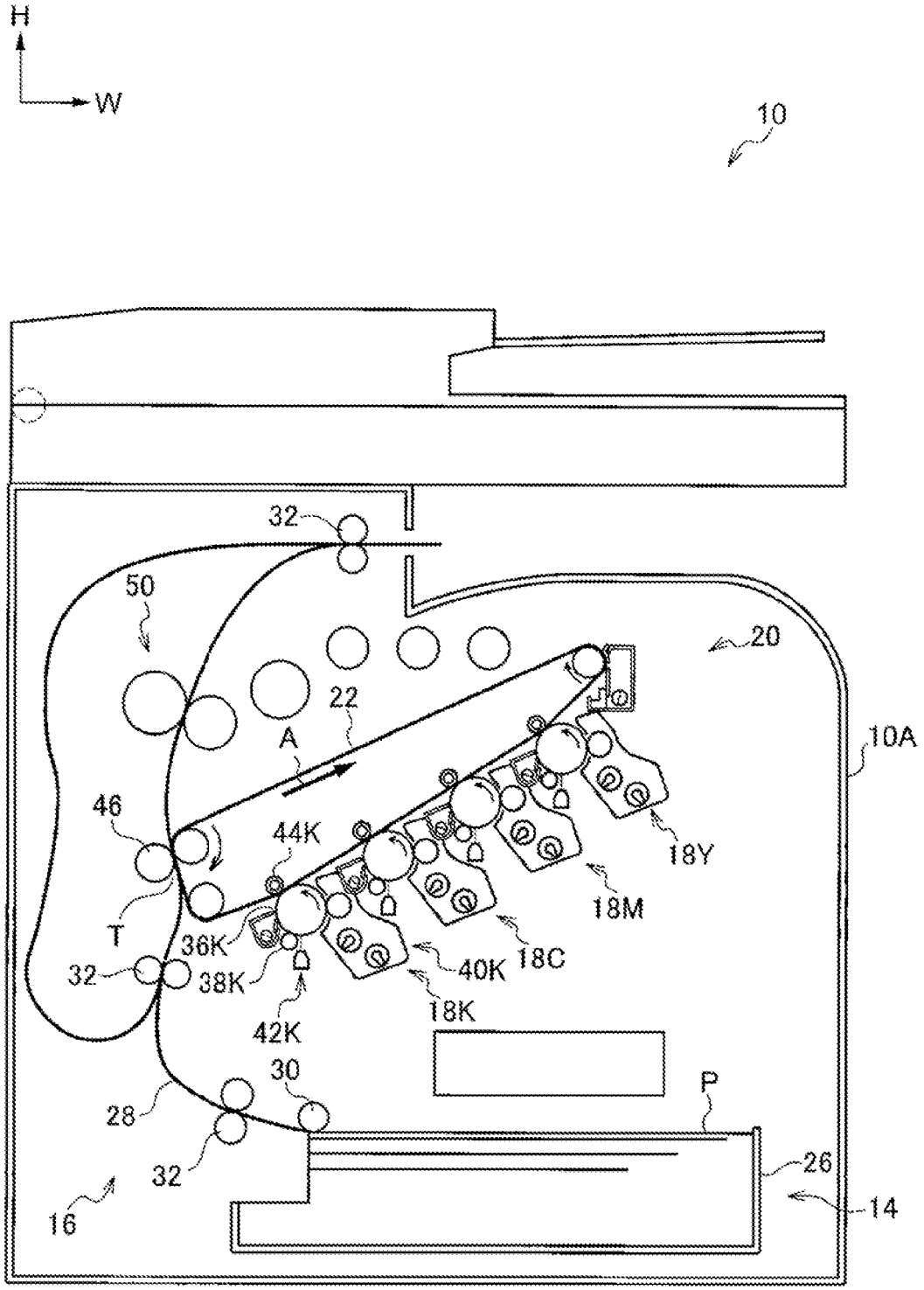
FIG. 14 is a schematic configuration diagram illustrating an image forming apparatus according to the first exemplary embodiment of the invention.

As illustrated in FIG. 14, the image forming apparatus 10 according to the first exemplary embodiment is provided with a storage unit 14 in which a sheet member P as a recording medium is stored, a transport unit 16 that transports the sheet member P stored in the storage unit 14, and an image forming unit 20 that performs an image-forming on the sheet member P transported from the storage unit 14 by the transport unit 16 in this order, towards an upper side from a lower side of a up-and-down direction (direction of arrow H).

(Storage Unit)

The storage unit 14 is provided with a storage member 26 which can be drawn out to the front side of the apparatus depth direction from an apparatus main body 10A of the image forming apparatus 10, and the sheet member P is loaded on the storage member 26. Furthermore, the storage member 26 is provided with a delivery roll 30 that feeds the sheet member P loaded on the storage member 26 to a transporting path 28 configuring the transport unit 16.

(Transport Unit)

The transport unit 16 is provided with plural transport rolls 32 that transports the sheet member P along the transporting path 28 in which the sheet member P fed from the storage unit 14 is transported.

(Image Forming Unit)

The image forming unit 20 is provided with four image forming units 18Y, 18M, 18C, and 18K of yellow (Y), magenta (M), cyan (C), and black (K). In the following description, in a case where there is no need to be described to distinguish Y, M, C, and K, it may be described by omitting Y, M, C, and K.

The image forming units 18 of each color are respectively detachable from the apparatus main body 10A. The image forming units 18 of each color are provided with an image holding member 36, a charging member 38 that charges a front surface of the image holding member 36, and an exposure device 42 that irradiates respectively an exposure light on the image holding member 36. Furthermore, the image forming units 18 of each color are provided with a developing device 40 that develops an electrostatic latent image formed by the exposure device 42 irradiating the exposure light on the charged image holding member 36 to make and visualize a toner image.

The image forming unit 20 is provided with an endless transfer belt 22 revolving in the arrow A direction in the figure and a primary transfer roll 44 that transfers the toner image formed by the image forming units 18 of each color onto the transfer belt 22. Furthermore, the image forming unit 20 is provided with a secondary transfer roll 46 that transfers the toner image transferred onto the transfer belt 22 onto the sheet member P and a fixing unit 50 that heats and presses the sheet member P onto which the toner image is transferred to fix the toner image on the sheet member P.

A configuration of the exposure device 42 will be described later in detail.

(Effect of the Image Forming Apparatus)

An image is formed as follows in the image forming apparatus 10.

Firstly, the charging member 38 of each color to which a voltage is applied uniformly negatively charges a front surface of the image holding member 36 of each color by a scheduled potential. Subsequently, based on an image data received from an outside, the exposure device 42 irradiates the exposure light on the front surface of the charged image holding member 36 of each color to form the electrostatic latent image.

Thereby, the electrostatic latent image corresponding to data is formed on the front surface of the image holding member 36 of each color. Furthermore, the developing device 40 of each color develops the electrostatic latent image to visualize as the toner image. The toner image formed on the front surface of the image holding member 36 of each color is transferred onto the transfer belt 22 by the primary transfer roll 44.

Therefore, the sheet member P fed to the transporting path 28 from the storage member 26 by the delivery roll 30 is fed to a transfer position T where the transfer belt 22 and the secondary transfer roll 46 are in contact with each other. The sheet member P is transported between the transfer belt 22 and the secondary transfer roll 46 at the transfer position T, and thus the toner image on the front surface of the transfer belt 22 is transferred onto the front surface of the sheet member P.

The toner image transferred onto the front surface of the sheet member P is fixed on the sheet member P by the fixing unit 50. The sheet member P on which the toner image is fixed is discharged to the outside of the apparatus main body 10A.

(Configuration of Main Part)

Next, the exposure device 42 will be described.

Figure 13:
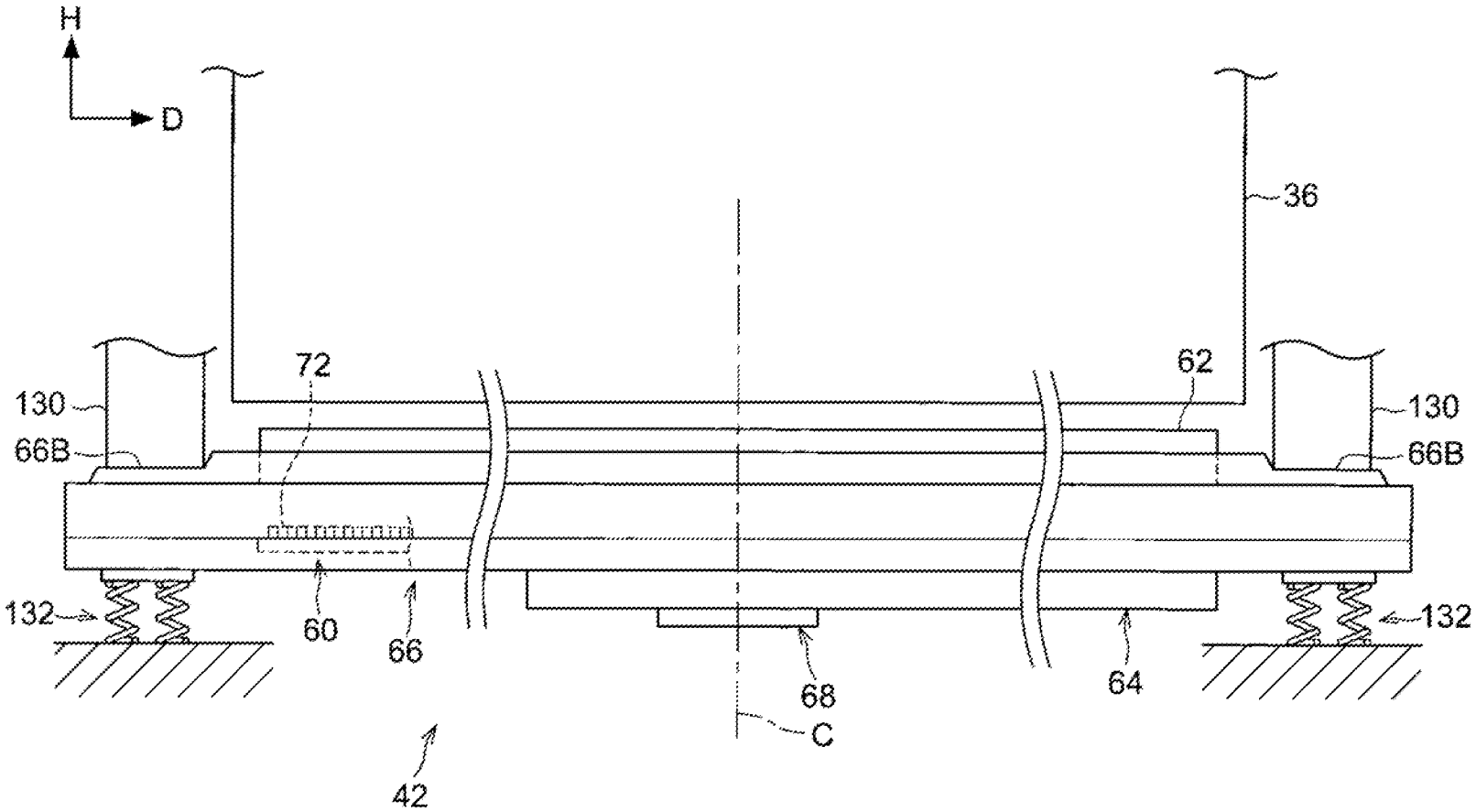
FIG. 13 is a front view illustrating the exposure device according to the first exemplary embodiment of the invention.

The exposure device 42 which is an LED print head, as illustrated in FIG. 13, is disposed at the lower side of the image holding member 36.

Figure 1:
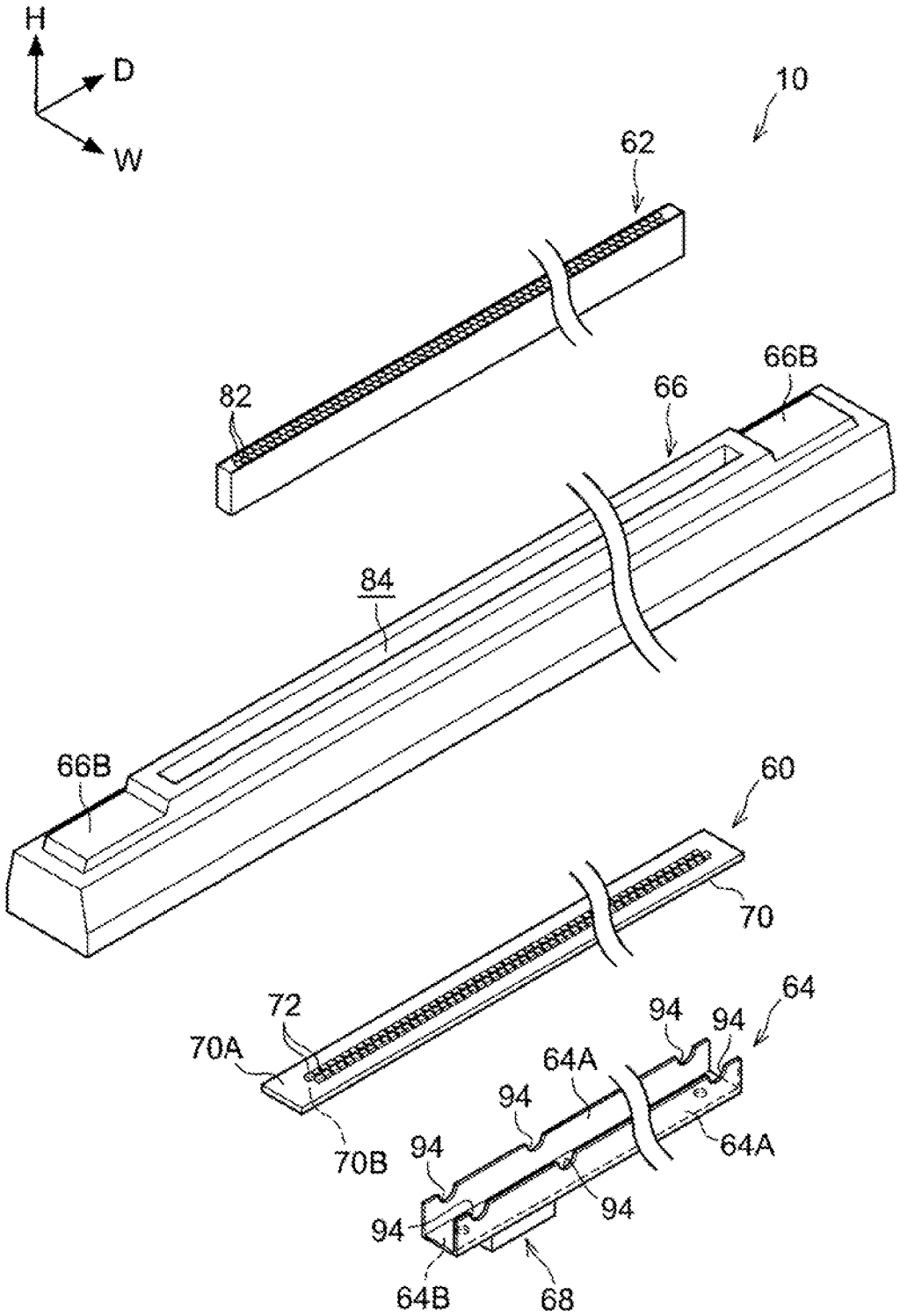
FIG. 1 is an exploded perspective view illustrating an exposure device according to a first exemplary embodiment of the invention.
Figure 3:
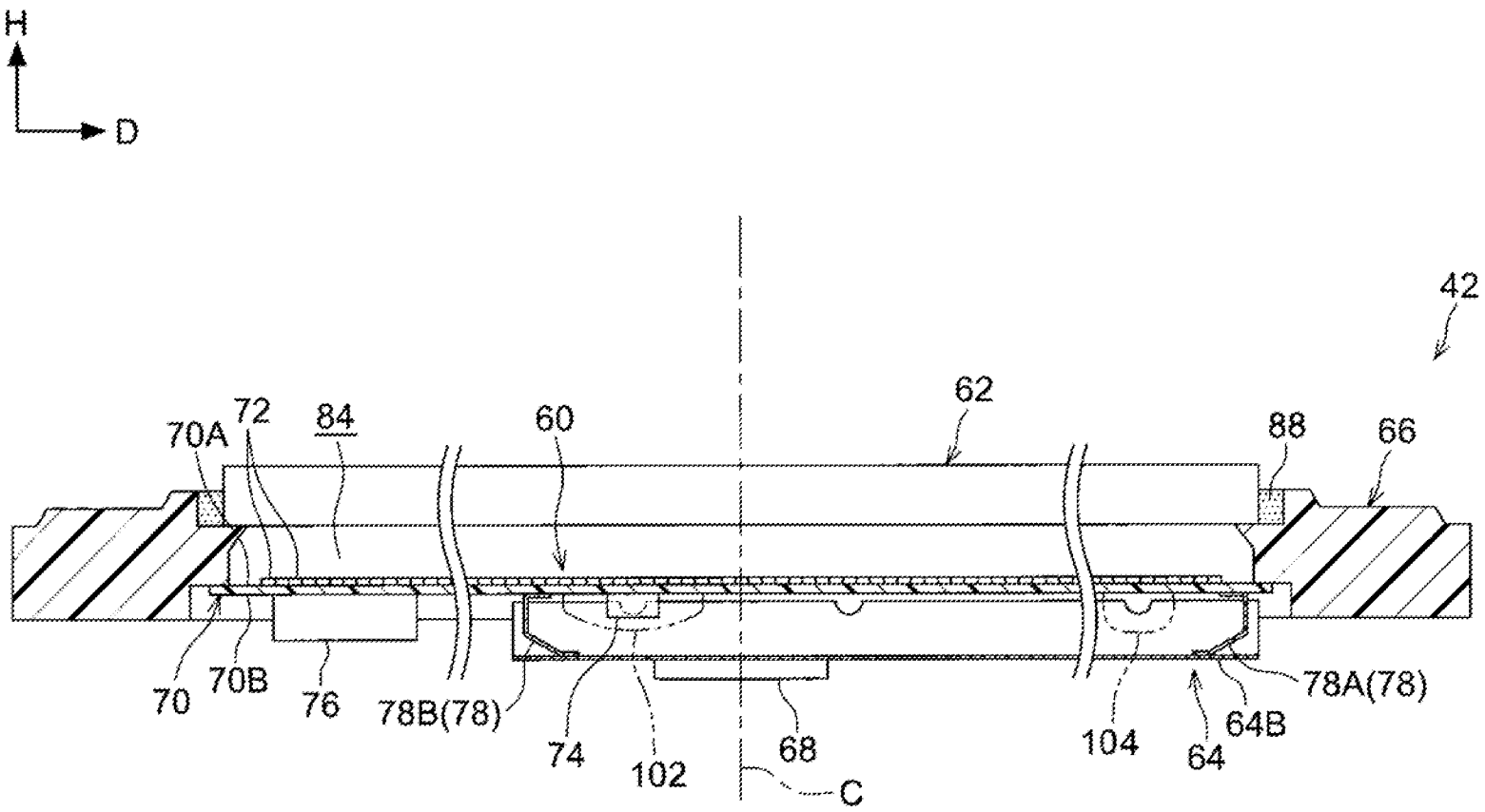
FIG. 3 is a sectional view illustrating the exposure device according to the first exemplary embodiment of the invention.

The exposure device 42, as illustrated in FIGS. 1 and 3, is provided with a substrate 60 that extends in the apparatus depth direction (one direction) and of which a plate surface is directed in the up-and-down direction, and a lens array 62 that is disposed on the upper side of the substrate 60 and extends in the apparatus depth direction. Furthermore, the exposure device 42 is provided with a housing 66 that extends in the apparatus depth direction, and to which the substrate 60 and the lens array 62 are fixed, a facing member 64 that sandwiches the substrate 60 and is disposed on a side opposite to the lens array 62, and a weight 68 that is fixed to the facing member 64.

(Substrate)

The substrate 60 includes a plate-shaped main body 70, plural light emitting elements 72 that are mounted on an upper surface 70A (one surface) of the main body 70 directed upward, and plural heating elements 74 (refer to FIG. 3) that are mounted on a lower surface 70B (the other surface) of the main body 70 directed downward.

Furthermore, the substrate 60, as illustrated in FIG. 3, includes a connector 76 that is connected to a harness-side connector (not illustrated) and a leaf spring 78 that is mounted on the lower surface 70B of the main body 70 as an example of a regulation member that regulates a position of the facing member 64 in the apparatus up-and-down direction.

The main body 70 which is a printed wiring substrate has a rectangular shape of which the apparatus depth direction extends as viewed from the upper side.

The light emitting element 72 which is a light emitting diode (LED), as illustrated in FIG. 1, is disposed in a zigzag shape and extends in the apparatus depth direction.

Figure 2:
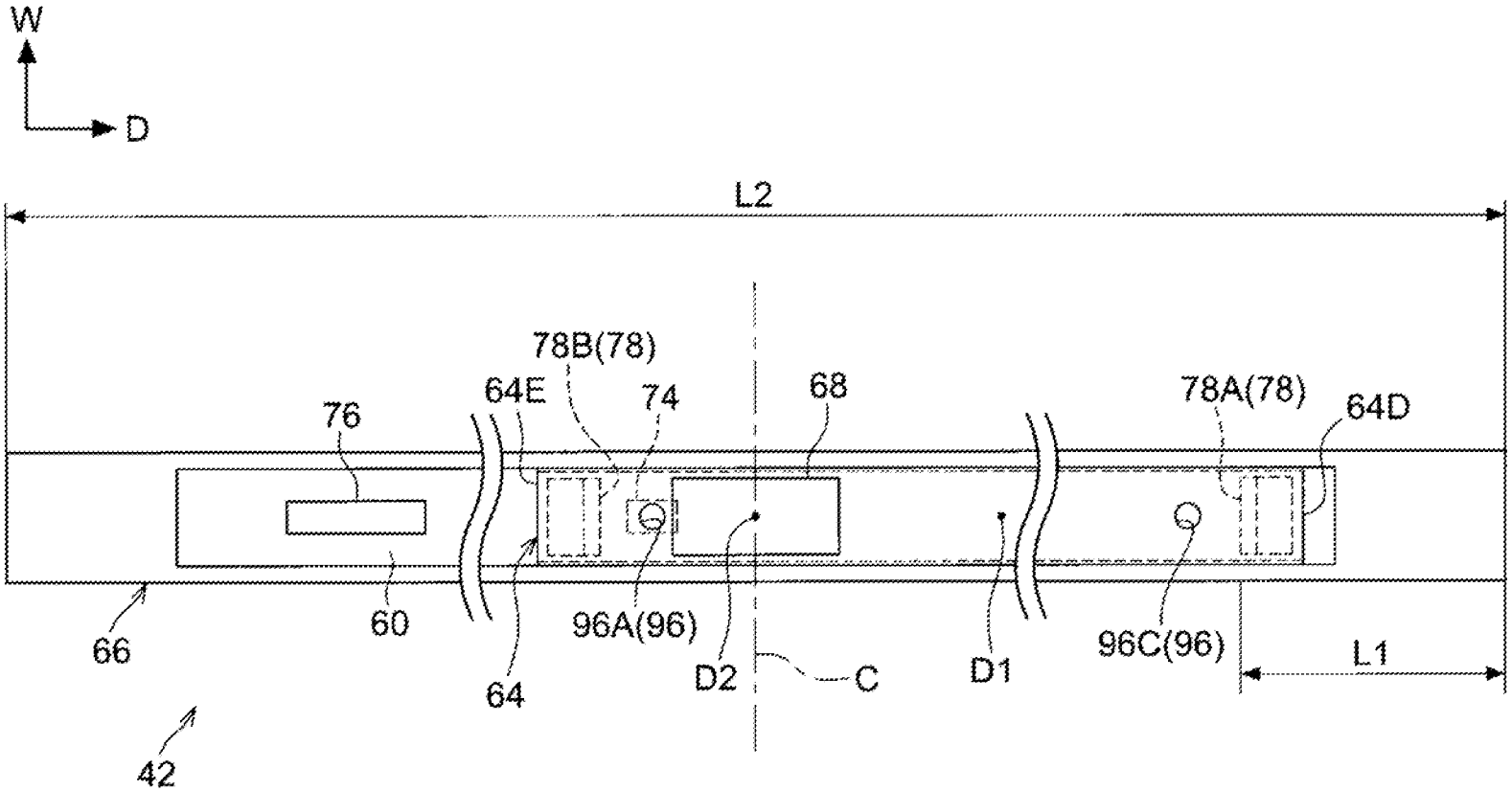
FIG. 2 is a bottom view illustrating the exposure device according to the first exemplary embodiment of the invention.

The heating element 74 is an active element or a passive element that generates heat in accordance with light emission of the light emitting element 72, in the exemplary embodiment, and is an integrated circuit (so-called ASIC) that controls each unit (refer to FIG. 3). The heating element 74, as illustrated in FIG. 2, is disposed in a central portion of the housing 66 in the apparatus depth direction and is disposed at a front side in the apparatus depth direction (left side in the figure) compared with a center line C (imaginary line) of the housing 66 in the apparatus depth direction.

The connector 76 is disposed at the front side in the apparatus depth direction (left side in the figure) compared with the heating element 74, as illustrated in FIG. 3, and protrudes downward compared with the heating element 74.

The leaf springs 78 are provided as a pair separated from each other in the apparatus depth direction. One of the leaf springs 78 (hereinafter 'the leaf spring 78A') is disposed at a rear side portion in the apparatus depth direction on the lower surface 70B of the main body 70 and the other of the leaf springs 78 (hereinafter 'the leaf spring 78B') is disposed between the heating element 74 and the connector 76 in the apparatus depth direction.

As viewed from the apparatus width direction, the leaf spring 78A and the leaf spring 78B have a symmetrical shape compared with the center line C of the housing 66. The leaf springs 78A and 78B of which base end portions are fixed to the lower surfaces 70B of the main body 70 and extend downward while bending.

(Lens Array)

The lens array 62, as illustrated in FIG. 1, has a rectangular parallelepiped shape extending in the apparatus depth direction. Plural rod lenses 82 are disposed in a zigzag shape on the lens array 62. Each of the rod lenses 82 transmits light emitted from each of the light emitting elements 72 so as to form an image on the image holding member 36 (refer to FIG. 13).

(Housing)

The housing 66 is molded of a liquid crystal polymer which is resin material and extends in the apparatus depth direction. Furthermore, a through hole 84 penetrating in the apparatus up-and-down direction is formed in the housing 66, and the through hole 84 extends in the apparatus depth direction. In this manner, the housing 66 has a frame shape.

Figure 5A:
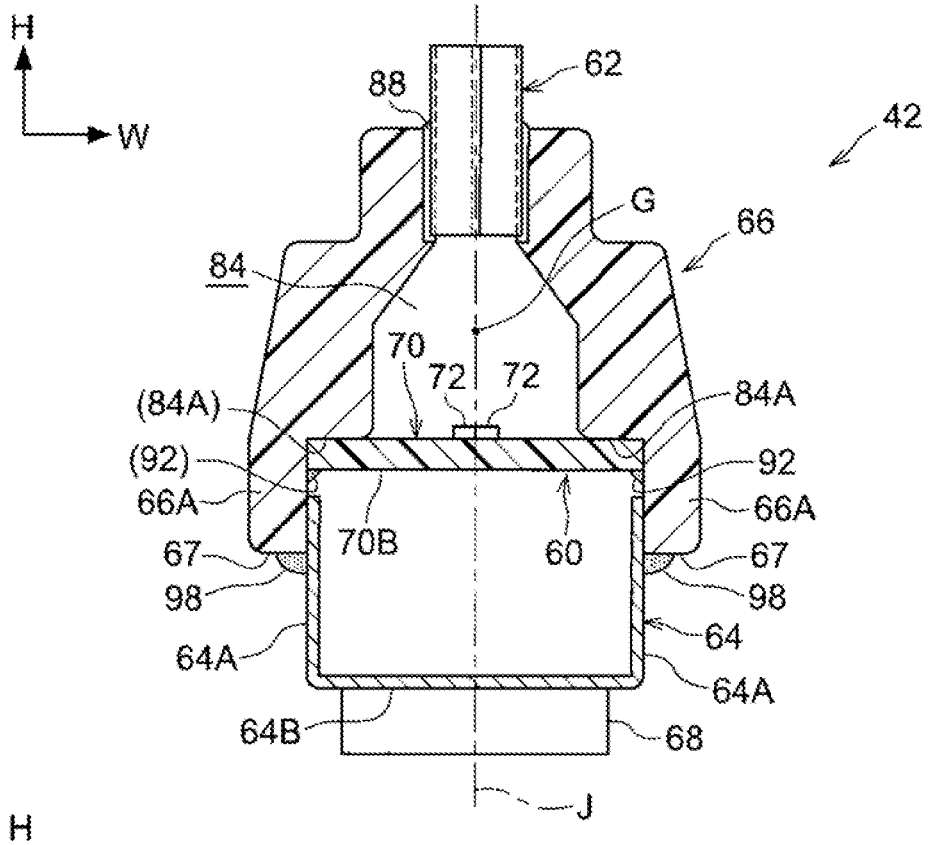
FIGS. 5A and 5B are sectional views illustrating the exposure device according to the first exemplary embodiment of the invention.

A cross-sectional shape of the housing 66 that is perpendicular to the apparatus depth direction, as illustrated in FIG. 5A, passes through a center of gravity G of the housing 66 and has a symmetrical shape compared with a line J extending in the apparatus up-and-down direction.

Furthermore, the lens array 62 is fixed by using an adhesive (UV-curable adhesive, not illustrated) to an upper end portion of the through hole 84 formed in the housing 66. A gap between the housing 66 and the lens array 62 is filled with a sealant 88 over the entire circumference of the lens array 62. Therefore, dust from a portion between the housing 66 and the lens array 62 is prevented from entering the inside of the housing 66.

Figure 7:
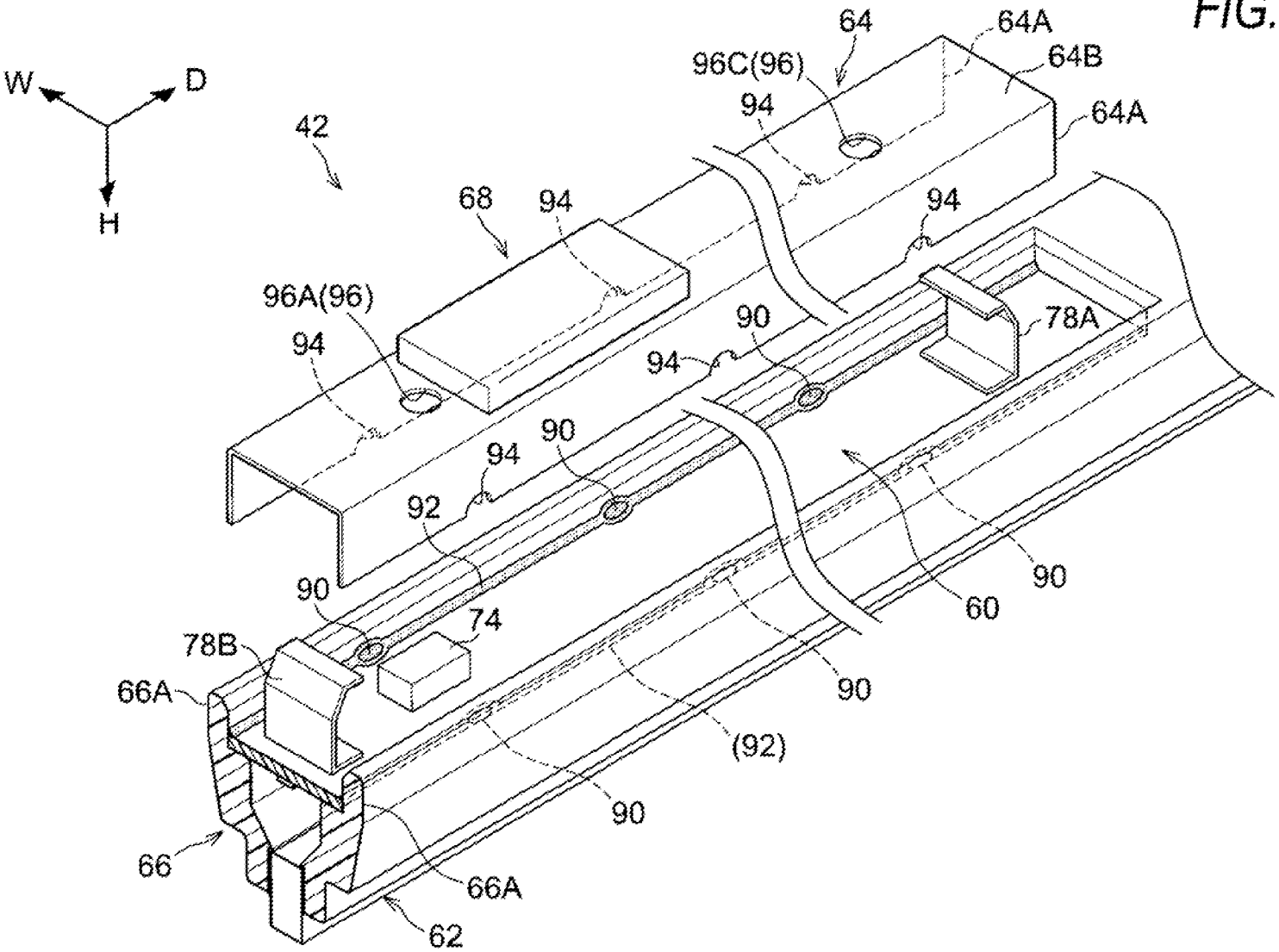
FIG. 7 is an exploded perspective view illustrating a suppression member of the exposure device according to the first exemplary embodiment of the invention.

In the housing 66, an stepped portion 84A is formed over the entire circumference of the through hole 84 so as to widen an opening of the lower end portion of the through hole 84. The substrate 60 is fixed to the stepped portion 84A so that the light emitting element 72 and the lens array 62 are opposed to each other. Specifically, the substrate 60 is sandwiched between a pair of wall portions 66A configuring the housing 66 in the apparatus width direction, as illustrated in FIG. 7, an end portion of the substrate 60 and the wall portion 66A are point-bonded using the adhesive 90 which is the UV-curable adhesive. Thereby, the substrate 60 is fixed to the housing 66.

Figure 5B:
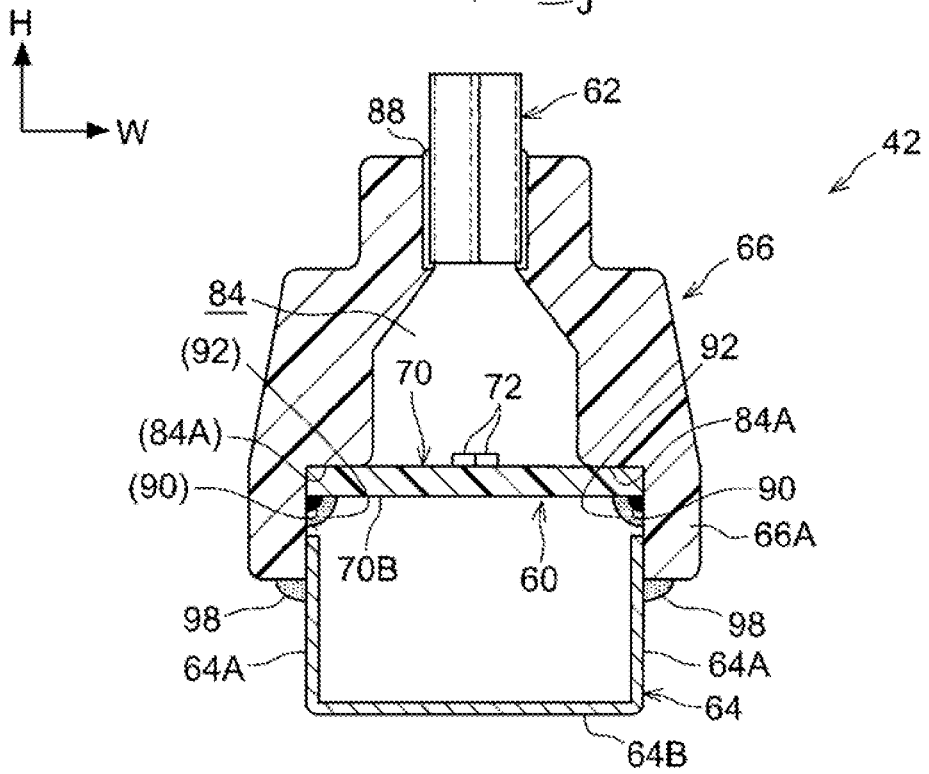

Furthermore, the sealant 92 is applied over the entire circumference of the substrate 60 between the end portion of the substrate 60 and the wall portion 66A, so that the dust from the portion between the housing 66 and the substrate 60 is prevented from entering the inside of the housing 66. As illustrated in FIG. 5B, the sealant 92 swells on portions where the substrate 60 is point-bonded using the adhesive 90, unlike on portions where the substrate 60 is not point-bonded (refer to FIG. 5A).

Furthermore, as illustrated in FIG. 13, a flat surface portion 66B directed to the upper side is formed on both end portions in the apparatus depth direction in the housing 66. The image forming apparatus 10 is provided with a pair of reference frames 130 being in contact with the flat surface portion 66B and a pair of pressing members 132 that is disposed on the opposite side of the reference frame 130 sandwiching the housings 66 and presses each of the flat surface portion 66B to the reference frame 130.

In this manner, both end sides in the apparatus depth direction in the housing 66 are supported, and thus the exposure device 42 is attached to the apparatus main body 10A.

(Facing Member)

The facing member 64 is formed by bending a metal plate (JIS G 3313 SECC), as illustrated in FIGS. 1 and 3, faces the lower surface 70B of the main body 70, and extends in the apparatus depth direction. Furthermore, a cross-sectional shape of the facing member 64 that is perpendicular to the apparatus depth direction, as illustrated in FIG. 5A, is a U-shape in which the lower surface 70B side of the main body 70 is open. Specifically, the facing member 64 is configured to include a pair of side plates 64A of which a thickness direction is directed in the apparatus width direction, and a bottom plate 64B that connects to a lower end portion of a pair of side plates 64A and of which a thickness direction is directed in the apparatus up-and-down direction.

Furthermore, as illustrated in FIG. 2, a center D1 of the facing member 64 (refer to the figure) in the apparatus depth direction is located at the rear side (one end side) in the apparatus depth direction of the housing 66, compared with a center D2 of the housing 66 in the apparatus depth direction. One end 64D of the facing member 64 is located at one end portion of the housing 66 (L1 in the figure), and the other end 64E of the facing member 64 is located at the other end side of the housing 66, compared with the center D2 of the housing 66.

In this manner, the facing member 64 is disposed at a position closer to the one end side of the housing 66. Here, in a case where the total length L2 of the housing 66 (refer to the figure) is set to 100%, one end portion of the housing 66 (L in the figure) is a portion with a length of up to 15% of the total length L2 from the one end of the housing 66.

In this configuration, as illustrated in FIG. 3, the bottom plate 64B of the facing member 64 is in contact with a tip portion of the leaf springs 78A and 78B, and thus a position in the up-and-down direction of the facing member 64 with respect to the substrate 60 is regulated (determined). Thereby, as illustrated in FIG. 5A, the end portion (open end portion) of the facing member 64, the substrate 60 and the sealant 92 are separated from each other in the up-and-down direction. In this state, a side plate 64A of the facing member 64 is sandwiched between a pair of the wall portions 66A in a width direction, and the facing member 64 is fitted in the through hole 84. The facing member 64 is located at the inner side than the outermost portion in a width direction of the housing 66.

Furthermore, on each of the end portions of side plate 64A, as illustrated in FIGS. 1 and 7, plural semicircular cutouts 94 are formed at intervals in the apparatus depth direction. Positions of the cutouts 94 in the apparatus depth direction are at the same position as the positions where the substrate 60 is point-bonded using the adhesive 90.

Here, as illustrated in FIG. 5B, the sealant 92 swells on the portions where the substrate 60 is point-bonded using the adhesive 90. However, the cutout 94 is formed on the side plate 64A of a portion corresponding to the adhesive 90, as described above. Therefore, the end portion of the facing member 64, the substrate 60, and the sealant 92 are separated from each other in the up-and-down direction at the portion on which the sealant 92 swells.

As illustrated in FIGS. 2 and 7, two through holes 96A and 96C penetrating a front and back are formed on the bottom plate 64B. The through holes 96A are an example of the injection portion. In the following description, a case where the through holes 96A and 96C are not distinguished between each other may be described as the through hole 96.

Figure 4:
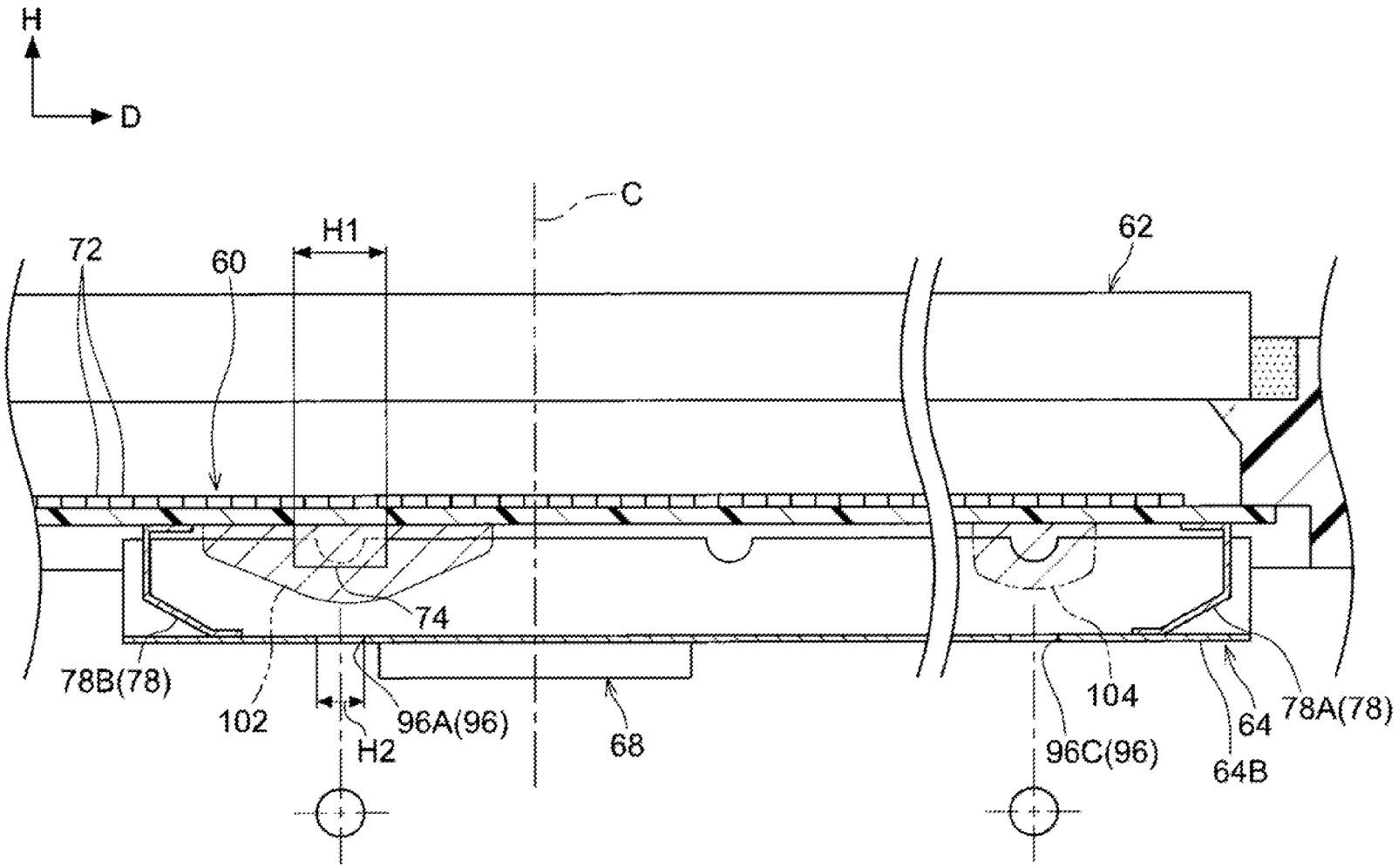
FIG. 4 is an enlarged sectional view illustrating the exposure device according to the first exemplary embodiment of the invention.

As illustrated in FIG. 4, the through hole 96A is formed so as to overlap at least partially the heating element 74 in the apparatus depth direction. Specifically, a range H1 occupied by the heating element 74 in the apparatus depth direction and a range H2 occupied by the through hole 96A in the apparatus depth direction overlap at least partially in the apparatus depth direction.

Furthermore, the through hole 96C is formed on the rear side portion in the apparatus depth direction (right side portion in the figure) in the bottom plate 64B.

As illustrated in FIG. 5A, an end surface 67 directed to the lower side is formed on the wall portion 66A of the housing 66. The side plate 64A of the facing member 64 and the end surface 67 are point-bonded using the adhesive 98 which is a UV-curable adhesive. The adhesive 98 is applied to the end surface 67 so as not to be visible outside of the apparatus width direction from the wall portion 66A. In this manner, the facing member 64 is fixed to the housing 66.

(Weight)

The weight 68, as illustrated in FIG. 7, has a rectangular parallelepiped shape extending in the apparatus depth direction and is fixed to a plate surface on a side opposite to the substrate 60 side on the bottom plate 64B.

Specifically, the weight 68 is fixed using a caulking method, as illustrated in FIG. 3, and overlaps a center line C of the housing 66 in the apparatus depth direction.

(Others)

Figure 6:
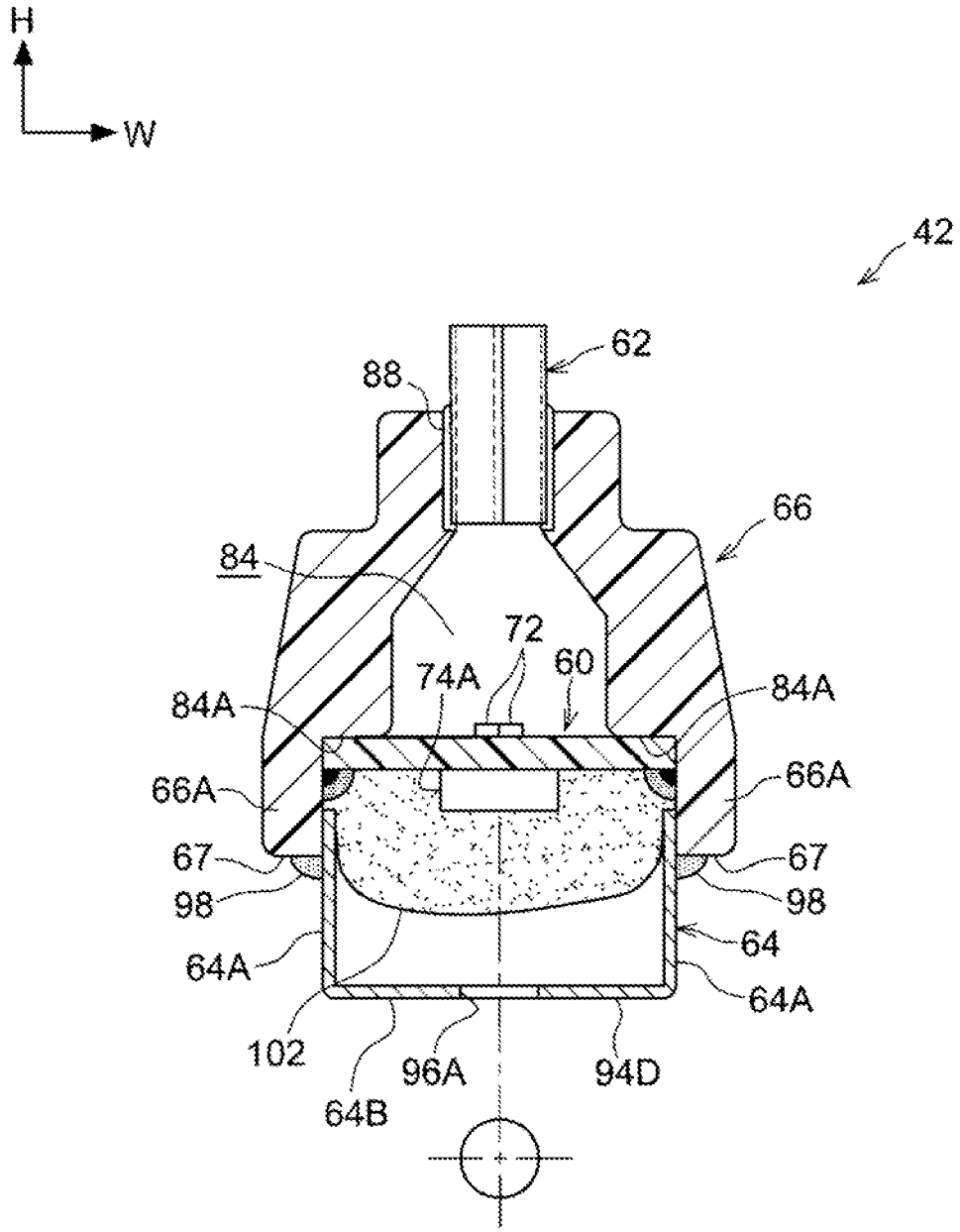
FIG. 6 is a sectional view illustrating the exposure device according to the first exemplary embodiment of the invention.
Figure 12:
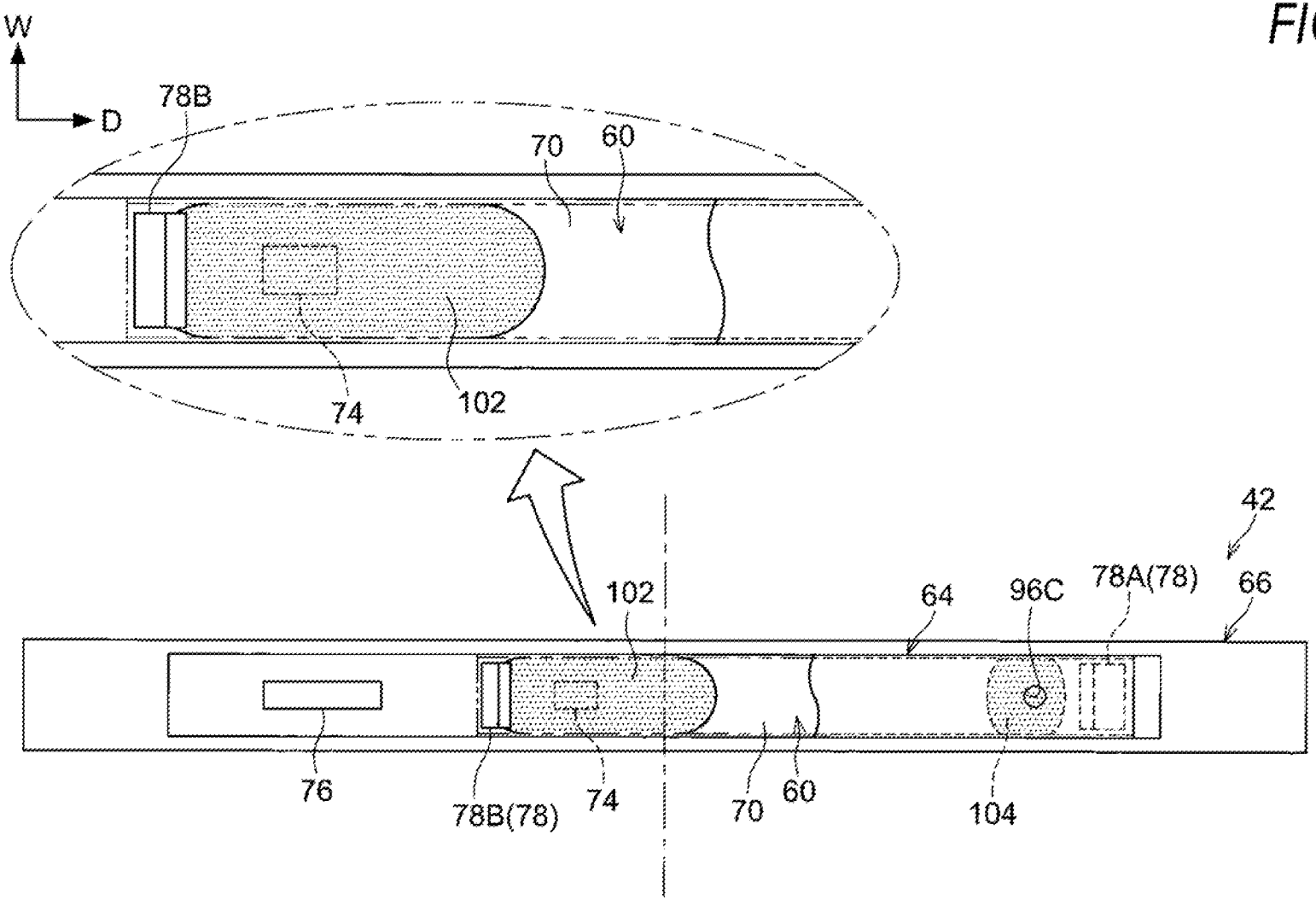
FIG. 12 is a bottom view illustrating the exposure device with respect to the first exemplary embodiment of the invention.

A contact resin 102 as an example of a contact member that is in contact with at least a portion of the heating element 74 and the main body 70 at a different position in the apparatus depth direction, as illustrated in FIGS. 6 and 12, extends in the apparatus depth direction.

The contact resin 102 is a resin having an insulating property, in the exemplary embodiment, covers the entire heating element 74, and is in contact with the facing member 64. The contact resin 102 is surrounded by the substrate 60, a pair of the wall portions 66A, and the facing member 64. When viewed from the substrate 60 side through the through hole 96A, the contact resin 102 covers the heating element 74.

Furthermore, as illustrated in FIGS. 4 and 12, the main body 70 and the contact resin 104 that is in contact with the facing member 64 are disposed between a portion where the through hole 96C is formed and the main body 70 in the bottom plate 64B. The contact resin 104 is an example of another contact member. The contact resin 104 is surrounded by the substrate 60, a pair of the wall portions 66A, and the facing member 64.

As the contact resins 102 and 104, for example, a room temperature moisture-curable adhesive is used.

(Manufacturing Method)

Next, a manufacturing method for manufacturing the exposure device 42 will be described. Arrows UP illustrated in FIGS. 8 to 11 indicate an upper side of the vertical direction.

Figure 8A:
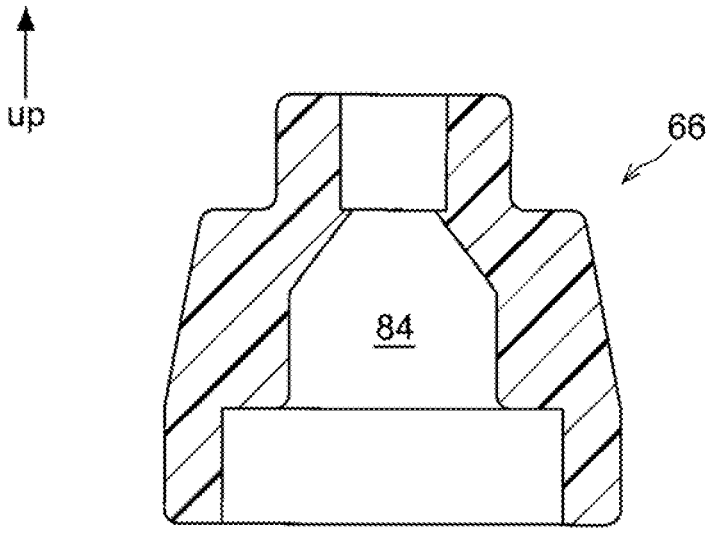
FIGS. 8A and 8B are sectional views used to explain a manufacturing method for the exposure device according to the first exemplary embodiment of the invention.
Figure 8B:
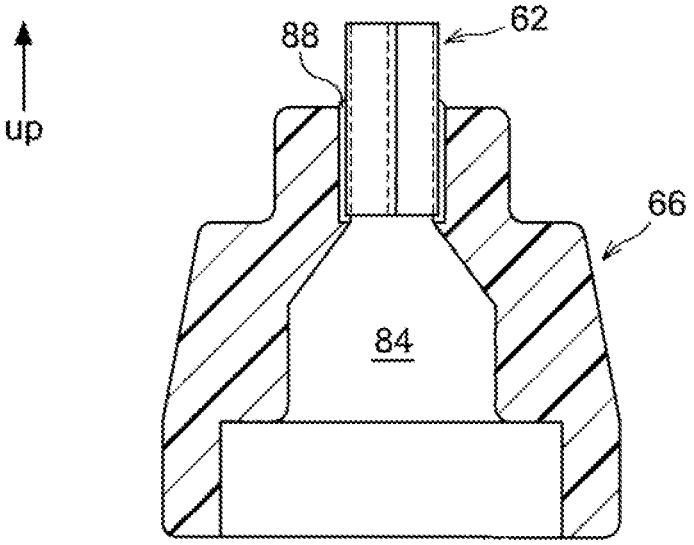

Firstly, in a lens fixing process, as illustrated in FIGS. 8A and 8B, the lens array 62 is fixed to the housing 66 in which a fixed portion of the lens array 62 is disposed so as to be located at the upper side. Specifically, a portion of the lens array 62 is inserted from the upper side into the through hole 84, and the lens array 62 is point-bonded to the housing 66 using the UV-curable adhesive (not illustrated). A portion between the housing 66 and the lens array 62 is filled with the sealant 88. Thereby, the lens array 62 is fixed to the housing 66.

Figure 9A:
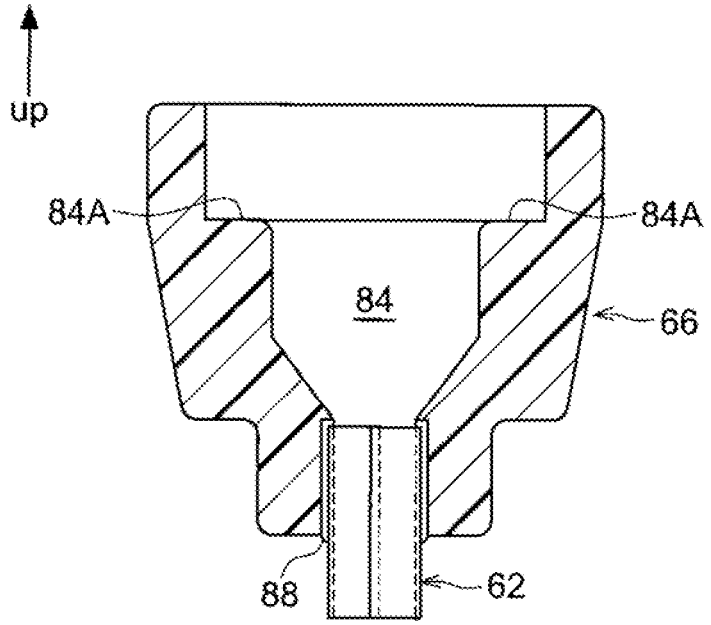
FIGS. 9A and 9B are sectional views used to explain the manufacturing method for the exposure device according to the first exemplary embodiment of the invention.
Figure 9B:
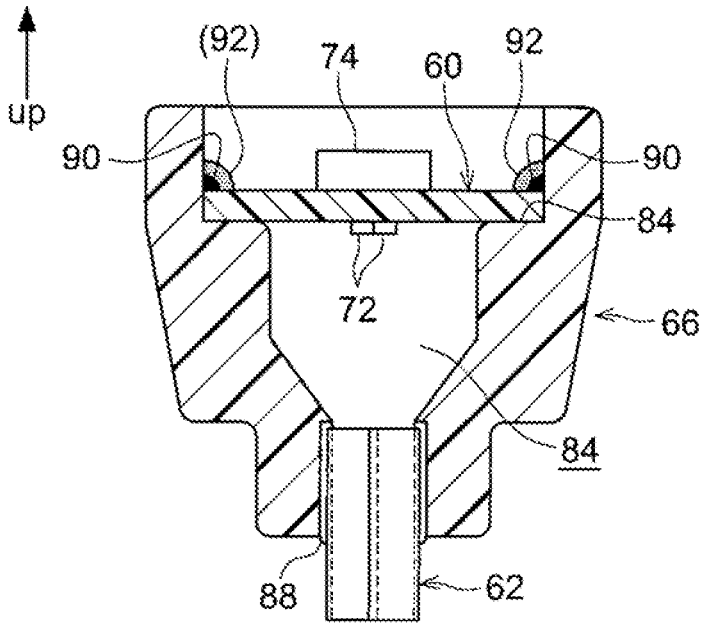

Furthermore, in a substrate fixing process, as illustrated in FIGS. 9A and 9B, the substrate 60 is fixed to the housing 66 which is upside down with respect to the lens fixing process. Specifically, the substrate 60 is mounted on the stepped portion 84A, and the substrate 60 is point-bonded to the wall portion 66A using the adhesive 90. The adhesive 90 is irradiated with ultraviolet light to be cured. Thereafter, the sealant 92 is applied between the substrate 60 and the wall portion 66A. Thereby, the substrate 60 is fixed to the housing 66.

Figure 10A:
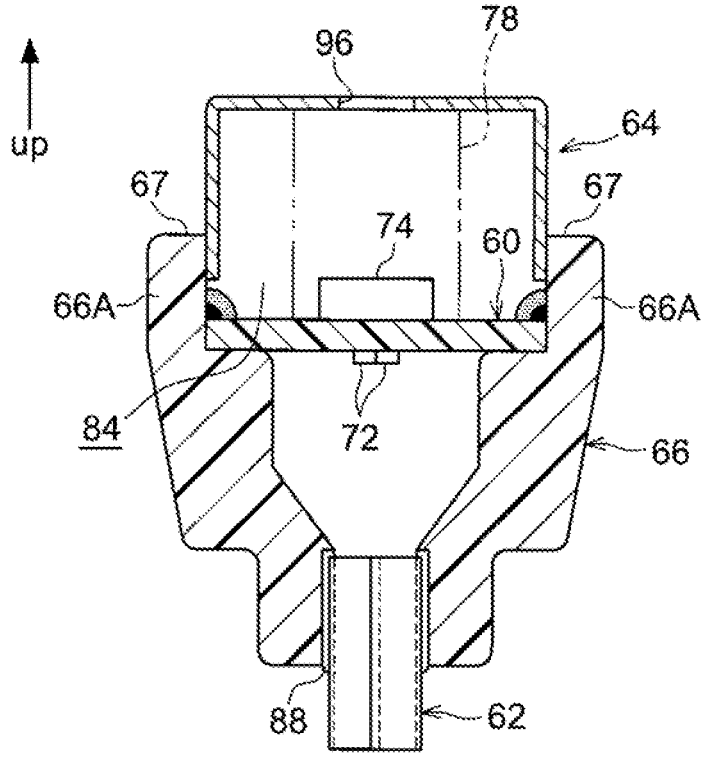
FIGS. 10A and 10B are sectional views used to explain the manufacturing method for the exposure device according to the first exemplary embodiment of the invention.
Figure 10B:
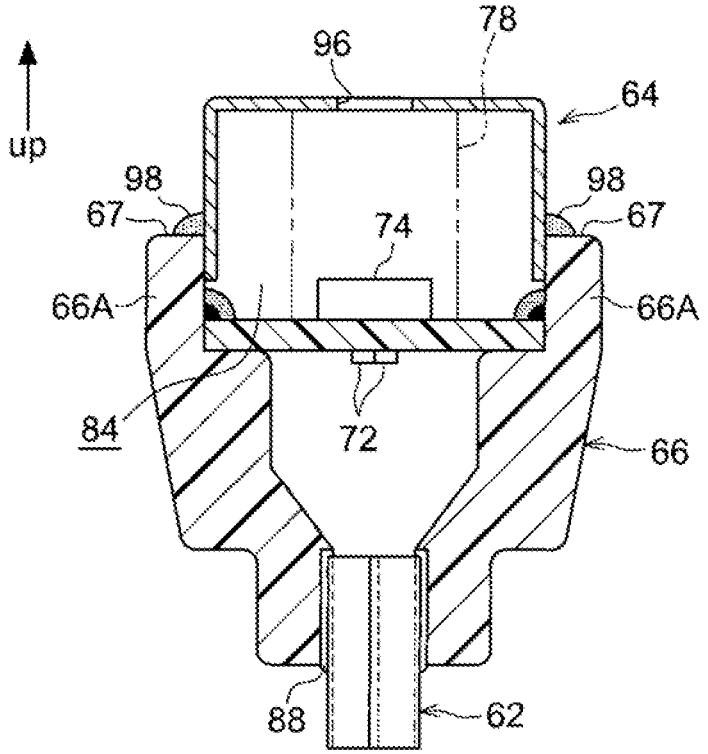

Furthermore, in a member fixing process, as illustrated in FIGS. 10A and 10B, the facing member 64 is fixed to the housing 66. Specifically, the open end portion of the facing member 64 is directed to the substrate 60 side, and a portion of the facing member 64 is fitted into the through hole 84 so as to sandwich the facing member 64 with a pair of the wall portions 66A. The facing member 64 is pressed to a tip portion of the leaf spring 78 to position the facing member 64. The side plate 64A of the facing member 64 is point-bonded to the end surface 67 of the wall portion 66A using the adhesive 98. Furthermore, the adhesive 98 is irradiated with ultraviolet light to be cured. Thereby, the facing member 64 is fixed to the housing 66.

Figure 11A:
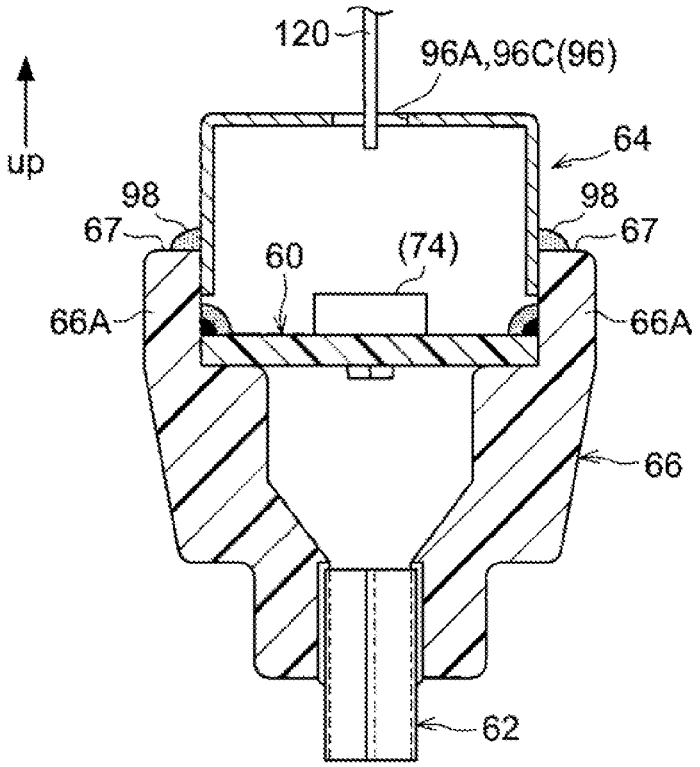
FIGS. 11A and 11B are sectional views used to explain the manufacturing method for the exposure device according to the first exemplary embodiment of the invention.
Figure 11B:
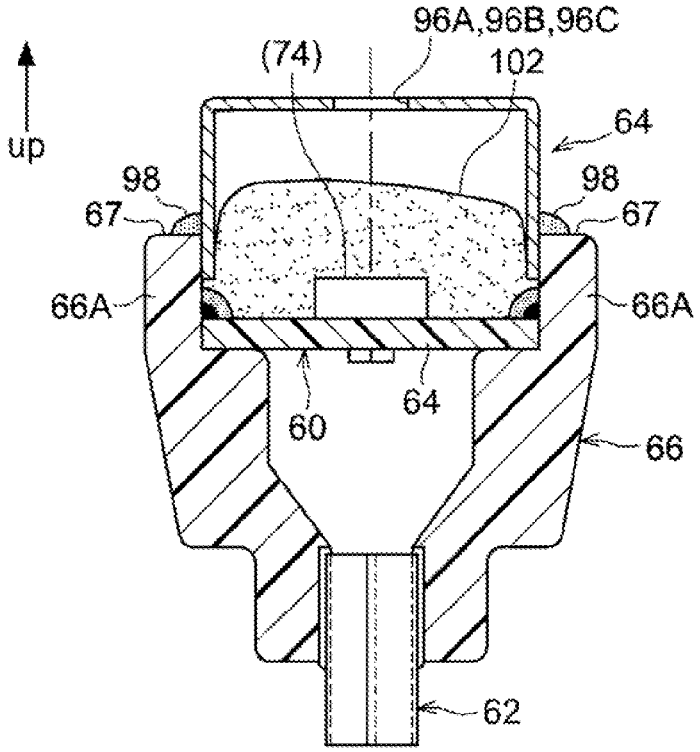

Furthermore, in a resin injection process, as illustrated in FIGS. 11A and 11B, a softened resin that becomes the contact resins 102 and 104 when cured is poured from the through holes 96. Specifically, a tip portion of an injection needle 120 of a dispenser is inserted into the through holes 96, and the softened resin is poured into a region surrounded by the substrate 60, a pair of the wall portions 66A, and the facing member 64. The injected resin is naturally dried and cured, and thus the contact resins 102 and 104 are formed. The exposure device 42 is manufactured according to the above processes.

(Effects)

Next, effects of the exposure device 42 will be described.

When the front surface of the image holding member 36 is charged, based on the image data received from outside of the exposure device 42, the exposure device 42 causes the light emitting element 72 to emit the light to be irradiated with the exposure light on the front surface of the image holding member 36 (refer to FIG. 13). Thereby, an electrostatic latent image is formed on the front surface of the image holding member 36. In accordance with the light emission of the light emitting element 72, the heating element 74 mounted on the lower surface 70B of the main body 70 generates heat (refer to FIG. 3).

Thereby, in a case where the contact resin 102 is not disposed in the exposure device, uneven temperature occurs in the substrate 60. A light intensity of the light emitting element 72 mounted on a higher temperature portion of the main body 70 becomes smaller than a light intensity of the light emitting element 72 mounted on a lower temperature portion of the main body 70. In this case, an uneven light intensity in the apparatus depth direction occurs on the light emitting element 72.

However, the contact resin 102 that extends in the apparatus depth direction is in contact with at least the portion of the heating element 74 and the main body 70 at the different position in the apparatus depth direction. Therefore, the contact resin 102 takes the heat from a portion of the main body 70, where temperature increases due to the heat of the heating element 74 and the heating element 74. Thereby, compared with a case where the contact resin 102 is not provided, due to the heat generation of the heating element 74, uneven temperature in the apparatus depth direction (longitudinal direction of the substrate) generated in the substrate 60 is suppressed.

Since uneven temperature in the apparatus depth direction generated in the substrate 60 is suppressed, compared with a case where the contact resin 102 is not provided, an uneven light intensity of the light emitting element 72 in the apparatus depth direction is suppressed.

The contact resin 102 is in contact with the facing member 64. Therefore, heat taken by the contact resin 102 is transmitted to the facing member 64. The contact resin 102 in which temperature increases is suppressed due to heat being transmitted to the facing member 64, takes the heat from a portion of the main body 70, where the temperature increases due to the heat of the heating element 74 and the heating element 74. Thereby, compared with a case where the facing member 64 that is in contact with the contact resin 102 is not provided, uneven temperature in the apparatus depth direction (longitudinal direction of the substrate) generated in the substrate 60 is suppressed.

Since uneven temperature in the apparatus depth direction (longitudinal direction of the substrate) generated in the substrate 60 is suppressed, compared with a case where the facing member 64 is not provided, an uneven light intensity of the light emitting element 72 in the apparatus depth direction is suppressed.

The facing member 64 is formed of metal. Therefore, the amount of heat transmitted from the contact resin 102 to the facing member 64 is increased, compared with a case where the facing member, for example, is formed of resin.

The contact resin 104 that is in contact with the rear side portion of the main body 70 in the apparatus depth direction and the facing member 64 is disposed (refer to FIGS. 4 and 12). Therefore, the heat transmitted to the facing member 64 is transmitted to the main body 70 via the contact resin 104. The main body 70 of the portion that is not heated by the heating element 74 is heated. Therefore, a temperature difference between the portion of the main body 70 to be heated by the heating element 74 and the portion of the main body 70 not to be heated by the heating element 74 is reduced. Thereby, compared with a case where the contact resin 104 is not provided, uneven temperature in the apparatus depth direction generated in the substrate 60 is suppressed.

Since uneven temperature in the apparatus depth direction generated in the substrate 60 is suppressed, compared with a case where the contact resin 104 is not provided, uneven light intensity of the light emitting element 72 in the apparatus depth direction is suppressed.

The contact resin 102 covers and is in contact with the entire heating element 74. Therefore, compared with a case where the contact resin is partially in contact with the heating element 74, the amount of heat that the contact resin 102 takes from the heating element 74 is increased.

The through holes 96A and 96C are formed on the facing member 64 in order to inject the contact resins 102 and 104 between the substrate 60 and the facing member 64. Thereby, even after the facing member 64 is fixed to the housing 66, the soft resin that becomes the contact resins 102 and 104 when cured is injected between the substrate 60 and the facing member 64 via the through hole 96.

If fixing the facing member 64 to the housing 66 is tried after the contact resins 102 and 104 are applied (injected) to the substrate 60, the contact resins 102, and 104 and the facing member 64 may interfere with each other, and the facing member 64 may not be disposed at a fixed position of the facing member 64.

The contact resins 102 and 104 are surrounded by the substrate 60, a pair of wall portions 66A, and the facing member 64. Therefore, compared with a case where the contact resin is not surrounded by the substrate 60, the pair of wall portions 66A, and the facing member 64, resin injected between the substrate 60 and the facing member 64 via the through hole 96 is prevented from leaking outside of the exposure device 42.

The through hole 96 is formed on the metallic facing member 64. Therefore, for example, compared with a case where the through hole is formed on the housing 66 formed of resin, decrease in bending rigidity of the exposure device 42 is suppressed.

In the apparatus depth direction, the through hole 96A and the heating element 74 are at least partially overlapped with each other. Therefore, in the apparatus depth direction, compared with a case where the through hole 96A and the heating element 74 do not overlap each other, the resin injected via the through hole 76A is prevented from being separated from the heating element 74.

The facing member 64 has a U-shape in which the substrate 60 side is open. Therefore, interference is suppressed between an element mounted on the lower surface 70B of the main body 70 and the facing member 64, compared with a case where the substrate 60 side of the facing member is not open.

The contact resin 102 as the contact member is the resin member having an insulating property. Therefore, the contact resin 102 is disposed without avoiding a conductive portion of the heating element 74, compared with a case where the contact member, for example, is a conductive paste which does not have the insulating property.

In the image forming apparatus 10, uneven light intensity of the light emitting element 72 in the apparatus depth direction is suppressed, compared with a case where the exposure device 42 is not provided, and thus quality degradation of an output image is suppressed.

Second Exemplary Embodiment

Figure 15:
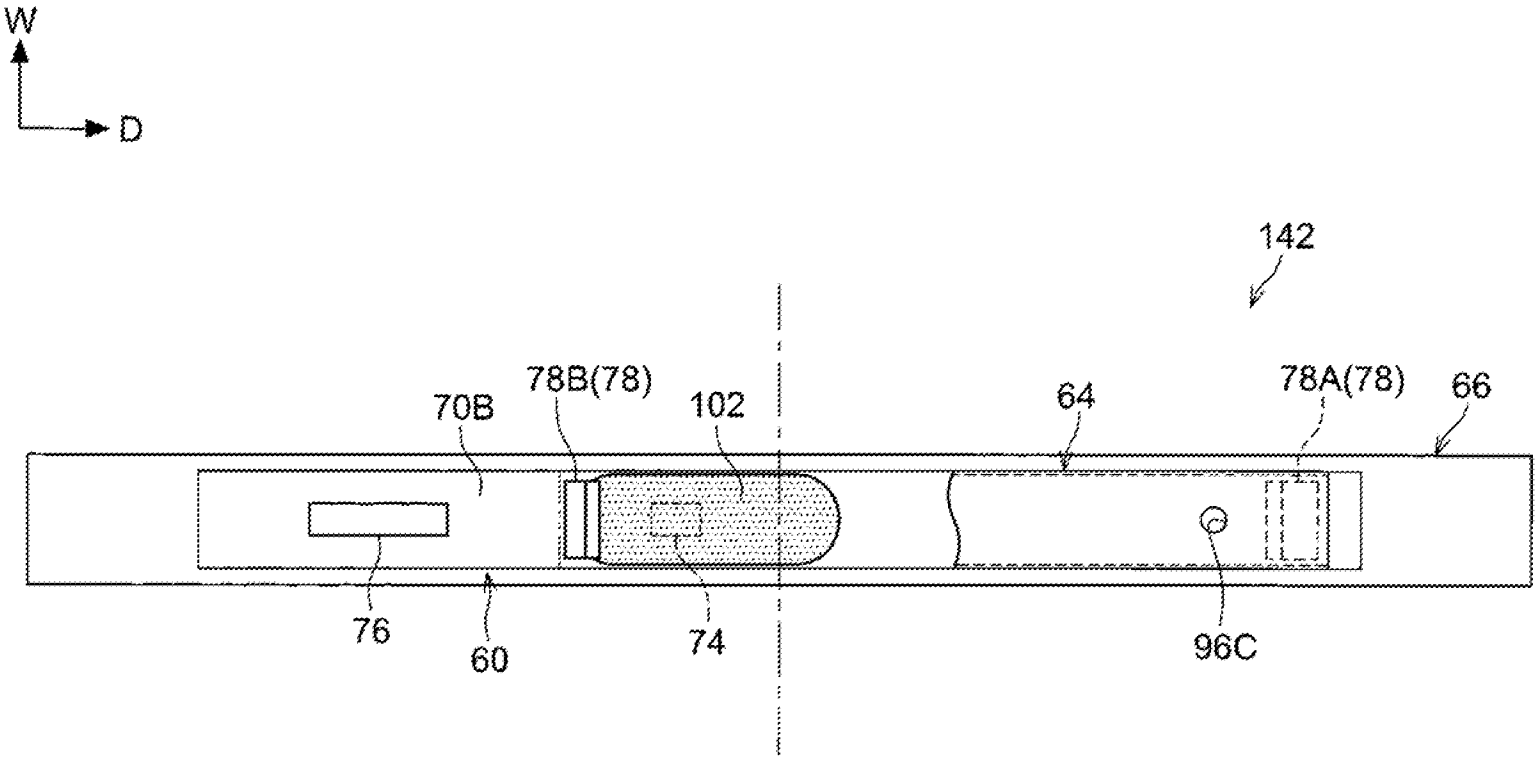
FIG. 15 is a bottom view illustrating an exposure device according to a second exemplary embodiment of the invention.

An example of an exposure device and an image forming apparatus according to a second exemplary embodiment of the invention will be described with reference to FIGS. 15 to 17. For the second exemplary embodiment, different portions from the first exemplary embodiment will be primarily described.

The exposure device 142 of the second exemplary embodiment is not provided with the contact resin 104.

Hereinafter, light intensity of the exposure device 142 will be described in comparison with light intensity of the exposure device 152 according to the comparative embodiment. Firstly, for the exposure device 152 according to the comparative embodiment, different portions from the exposure device 142 of the second exemplary embodiment will be primarily described.

Figure 17:
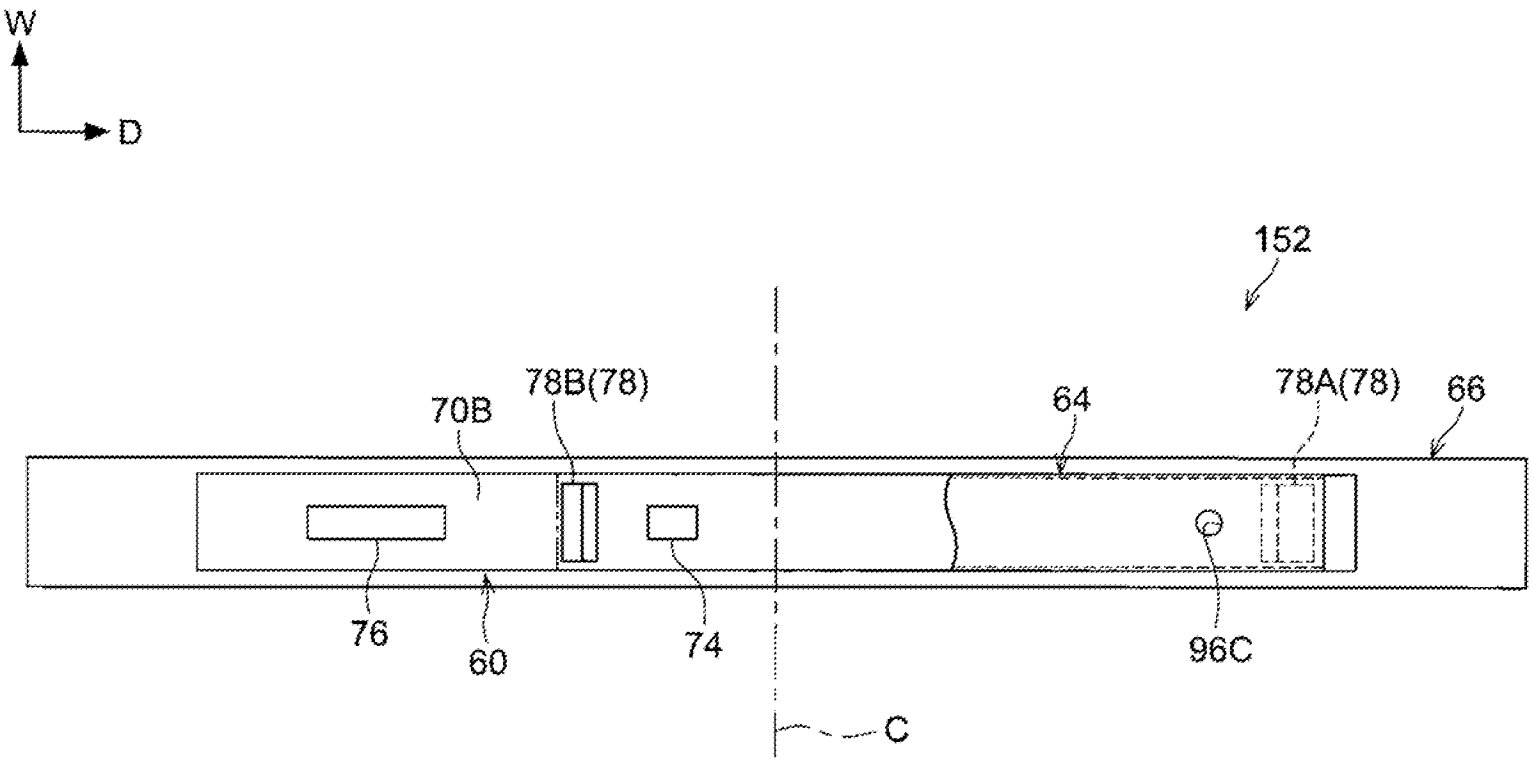
FIG. 17 is a bottom view illustrating an exposure device according to a comparative form with respect to the second exemplary embodiment of the invention.

The exposure device 152, as illustrated in FIG. 17, is not provided with the contact resin 102.

Next, a graph illustrated in FIG. 16 on which the light intensity of the exposure device 142 and the light intensity of the exposure device 152 are illustrated by a polygonal line will be described.

A vertical axis of the graph is a light intensity reduction rate, and indicates that the reduction rate is high as moving downward. A horizontal axis of the graph is the position in the apparatus depth direction of the light emitting element 72. A left side in the graph is the light emitting element 72 disposed on the front side in the apparatus depth direction and a right side in the graph is the light emitting element 72 disposed on the rear side in the apparatus depth direction. A solid line M1 in the graph is a light intensity reduction rate of the exposure device 142 and a dashed line M2 in the graph is the light intensity reduction rate of the exposure device 152.

Hereinafter, the light intensity reduction rate will be described. If the light intensity of immediately after lighting the light emitting element 72 is set to be K1, the light intensity of the light emitting element 72 when the heating element 74 generates heat and the temperature of the heating element 74 is saturated is set to be K2, and the light intensity reduction rate is set to be KT, a value calculated from a following equation (1) becomes the light intensity reduction rate KT.

$$\text{Light intensity reduction rate } KT = (\text{light intensity } K2 - \text{light intensity } K1)/\text{light intensity } K1 \quad \text{equation (1).}$$

Here, a "saturation" is a state where the temperature of the heating element 74 remains within ±2 [° C.].

Figure 16:
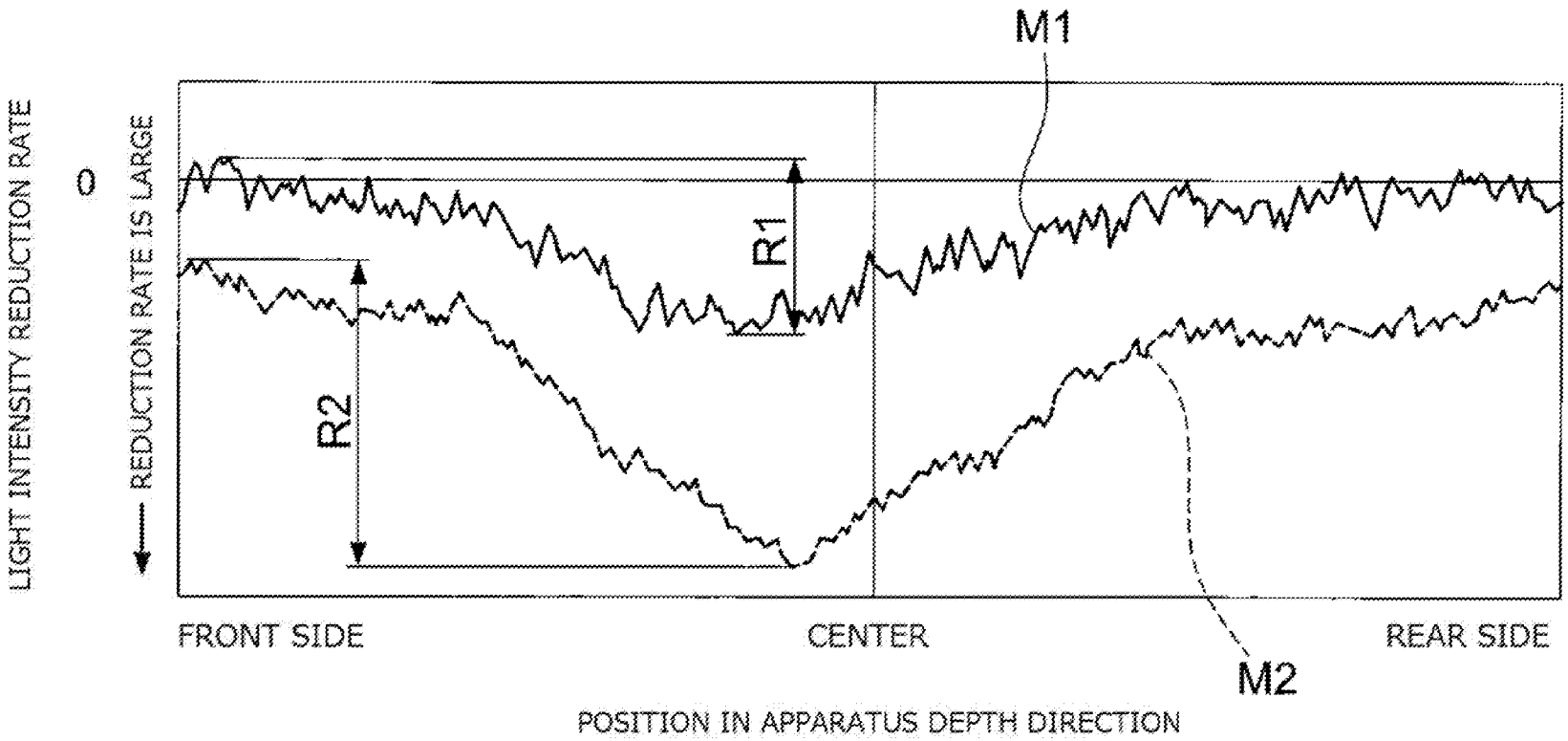
FIG. 16 is a drawing illustrating results of evaluating the exposure device with a graph according to the second exemplary embodiment of the invention.

It can be seen from the graph illustrated in FIG. 16 that the light intensity reduction rate KT (solid line M1) of the exposure device 142 is small, compared with the light intensity reduction rate KT (dashed line M2) of the exposure device 152. Furthermore, it can be seen that the difference between a maximum value and a minimum value of the light intensity reduction rate KT of the exposure device 142 (R1 in the figure) is small, compared with that of the exposure device 152 (R2 in the figure).

In this manner, it can be seen that the uneven light intensity of the light emitting element 72 in the apparatus depth direction is suppressed in the exposure device 142, compared with the exposure device 152.

Another effect of the second exemplary embodiment is the same as the effect of the first exemplary embodiment, except for an effects caused by providing the contact resin 104.

Third Exemplary Embodiment

Figure 18:
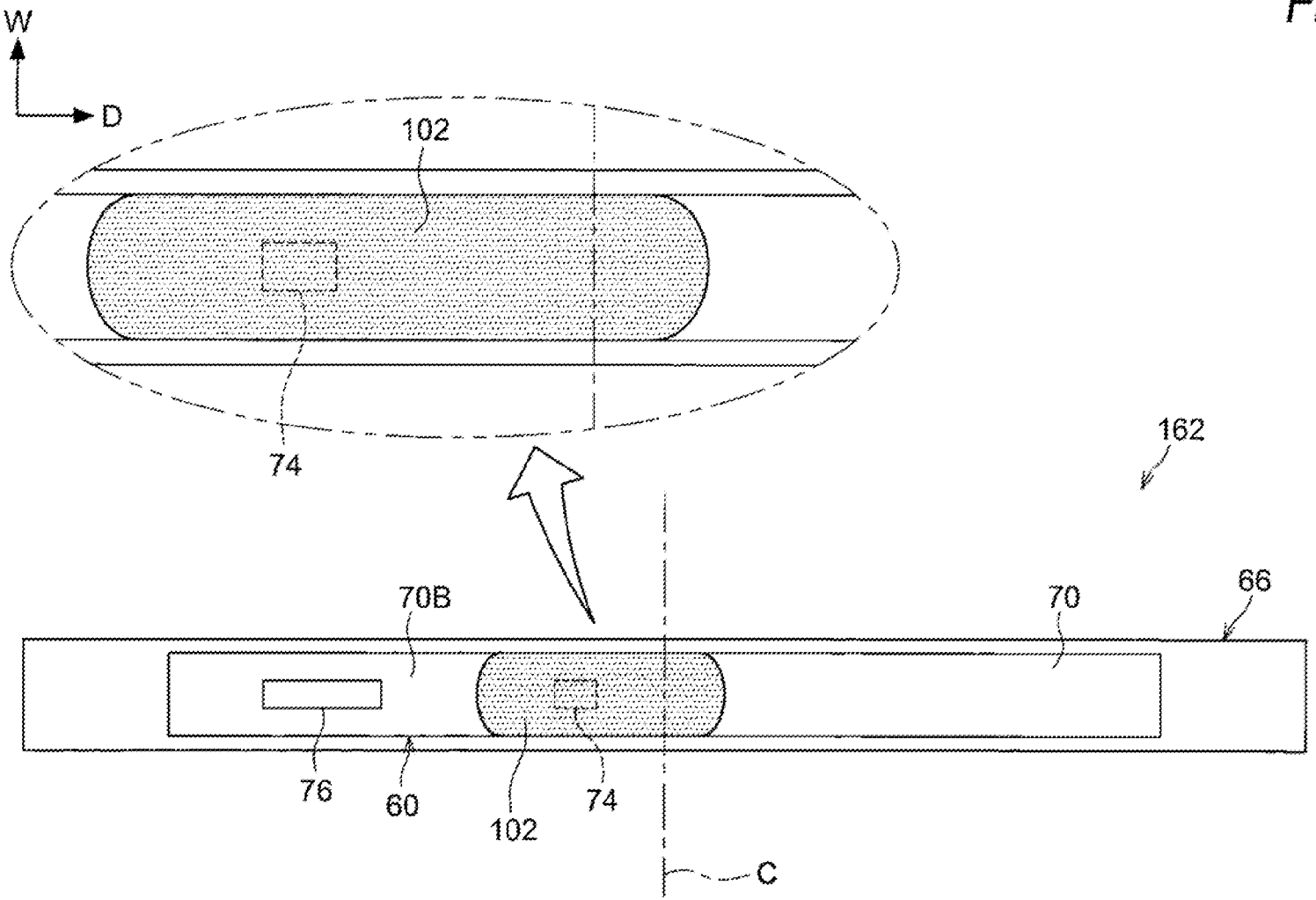
FIG. 18 is a bottom view illustrating an exposure device according to a third exemplary embodiment of the invention.

An example of an exposure device and an image forming apparatus according to a third exemplary embodiment of the invention will be described with reference to FIG. 18. For the third exemplary embodiment, different portions from the first exemplary embodiment will be primarily described.

The exposure device 162 of the third exemplary embodiment is not provided with the facing member 64, the contact resin 104, and the leaf spring 78.

An effect of the third exemplary embodiment is the same as the effect of the first exemplary embodiment, except for an effect caused by providing the facing member 64 and an effect caused by providing the contact resin 104.

Fourth Exemplary Embodiment

Figure 19:
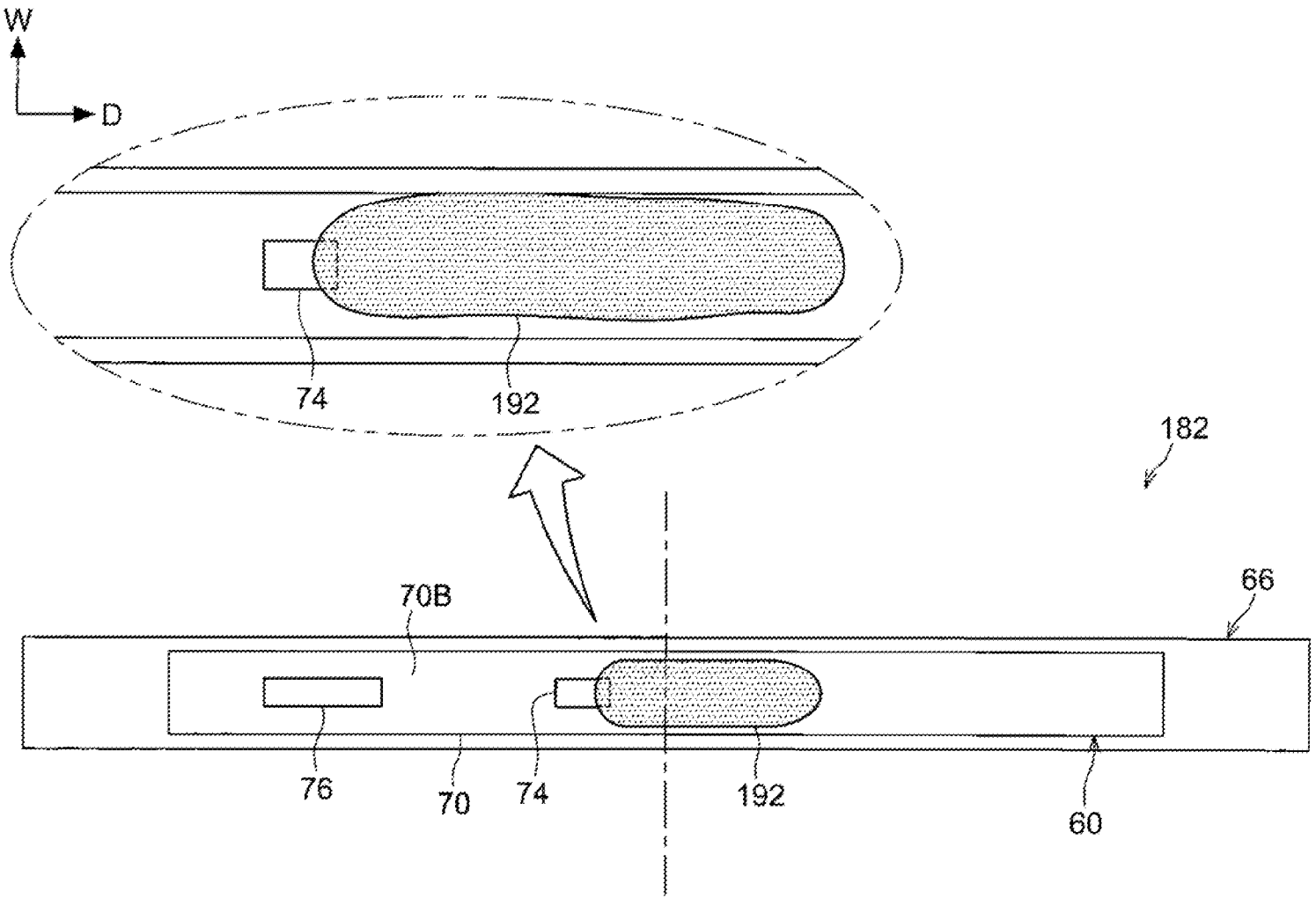
FIG. 19 is a bottom view illustrating an exposure device according to a fourth exemplary embodiment of the invention.

An example of an exposure device and an image forming apparatus according to a fourth exemplary embodiment of the invention will be described with reference to FIG. 19. For the fourth exemplary embodiment, different portions from the first exemplary embodiment will be primarily described.

The exposure device 182 of the fourth exemplary embodiment is not provided with the facing member 64, the contact resins 102, 104, and the leaf spring 78. Furthermore, the contact resin 192 as the example of the contact member provided in the exposure device 182 differs from the contact resin 102 provided in the exposure device 42, and does not cover the entire heating element 74. The contact resin 192 covers partially the heating element 74. Thereby, the contact member 192 is adapted to take heat from a portion of the heating element 74.

Another effect of the fourth exemplary embodiment is the same as the effect of the first exemplary embodiment, except for an effect caused by providing the facing member 64, an effect caused by providing the contact resin 104, and an effect caused by the contact resin 102 covering the entire heating element 74.

Although the invention is described in detail for a specific exemplary embodiment, the present invention is not limited to the exemplary embodiment according to the invention, and it is apparent to those skilled in the art that it is possible to take various other exemplary embodiments within the scope of the invention. For example, in the above first exemplary embodiment, although not specifically described, a length of the facing member 64 in the apparatus depth direction may be a length that is contact with the contact resins 102 and 104.

Although the contact resins 102 and 192 which are the example of the contact member are the resin member having the insulating property in the above exemplary embodiment, the contact member, for example, may be a conductive paste having a conductivity. However, in this case, an effect caused by the contact member which has the insulating property, does not occur.

In the above exemplary embodiment, although not specifically described, the contact member, for example, may be a metallic member having higher heat conductivity than the substrate. By using the metallic member, compared with a case of using a resin member having lower heat conductivity than the metallic member, the amount of heat transmitted to the main body 70 of different positions in the apparatus depth direction from the heating element 74 is increased.

In the above exemplary embodiment, although not specifically described, the heating element 74 may be a member that generates heat in accordance with causing the light emitting element 72 to emit the light, and may broadly be any of the active element and the passive element.

Although the light emitting element 72 is disposed in a zigzag shape, and extends in the apparatus depth direction in the above exemplary embodiment, the element may not be disposed in a zigzag shape, and may be disposed to extend in the apparatus depth direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure device comprising:

a substrate that includes a plate-shaped main body that extends in one direction, a plurality of light emitting elements that are mounted on one surface of the main body, and a heating element that is mounted on the other surface of the main body and generates heat in accordance with light emission of the light emitting element;

a housing that extends in the one direction, has a frame shape in which a through hole is formed, and to an inside of the through hole of which the substrate is fixed so that a thickness direction of the main body is a penetrating direction of the through hole; and a first contact member that extends in the one direction, and is in contact with at least a portion of the heating element and the main body at a different position in the one direction.

2. The exposure device according to claim 1, further comprising:

a metallic facing member that is fixed to the housing so as to face the other surface of the main body, wherein the first contact member is in contact with the facing member.

3. The exposure device according to claim 2, further comprising:

a second contact member that is separated from the first contact member in the one direction, and is in contact with the main body and the facing member, wherein the facing member extends in the one direction.

4. An image forming apparatus comprising:

an image holding member;

an exposure device according to claim 1 that exposes the image holding member, and forms an electrostatic latent image; and a developing device that develops the electrostatic latent image of the image holding member, formed by the exposure device.

* * * * *